US005092684A

United States Patent [19]

Weeks

[11] Patent Number: 5,092,684

[45] Date of Patent: Mar. 3, 1992

[54] POST-APPLIED ZIPPER BASE WITH GRIP STRIP

[75] Inventor: Ronald J. Weeks, Midland, Mich.

[73] Assignee: Illinois Tool Works Inc., Glenview, Ill.

[21] Appl. No.: 663,480

[22] Filed: Mar. 4, 1991

[51] Int. Cl.[5] ..... B65D 65/28

[52] U.S. Cl. ..... 383/61; 383/65; 428/34.3; 428/43

[58] Field of Search ..... 383/61, 63, 65; 428/34.3, 43, 167

[56] References Cited

U.S. PATENT DOCUMENTS

| | | | |
|---|---|---|---|
| 3,226,787 | 1/1966 | Ausnit | 383/65 |
| 3,780,781 | 12/1973 | Uramoto | 383/65 |
| 3,827,472 | 8/1974 | Uramoto | 383/61 |
| 4,363,345 | 12/1982 | Scheibner | 383/65 |
| 4,589,145 | 5/1986 | Van Erden et al. | 383/65 |
| 4,755,248 | 7/1988 | Geiger et al. | 383/63 |
| 5,022,530 | 6/1991 | Zieke | 383/61 |
| 5,023,122 | 6/1991 | Boeckmann et al. | 428/43 |

FOREIGN PATENT DOCUMENTS

| | | | |
|---|---|---|---|
| 398731 | 11/1990 | European Pat. Off. | 383/65 |

*Primary Examiner*—Gary E. Elkins
*Attorney, Agent, or Firm*—Thomas W. Buckman

[57] ABSTRACT

A method and apparatus for producing an improved easy-open container wherein a continuous base layer is integrally extruded with structure for gripping thereon and applied to existing film to seal perforated lines of tearing therein. Interlocking zipper elements are contemporaneously extruded and fused to the continuous base layer. Die clutter is reduced and the method produces a flexible container having desirable sealing, opening and gripping features.

13 Claims, 4 Drawing Sheets

POST-APPLIED ZIPPER BASE WITH GRIP STRIP

BACKGROUND OF THE INVENTION

The present invention relates to improvements in flexible containers, in particular, to a method and apparatus for making an improved zipper base with grip strip, and to the improved, easy-open, reclosable flexible container structure produced thereby.

Flexible containers made of thermoplastic film and having reclosable interlocking zipper elements are well-known and widely used. Where such containers are hermetically sealed across the bag mouth, various easy-open features have been devised to first break the seal before accessing the bag contents. Once opened, interlocked zipper elements may be opened by grasping the opposing bag lips and pulling them apart. Thus, various means for gripping have also been devised to improve the user's grip on the surfaces of opposing bag lips.

Among the easy-open features in the prior art are perforated or weakened lines of tearing. Boeckmann et al, U.S. Pat. No. 4,846,585, and Van Erden et al, U.S. Pat. No. 4,589,145, show such lines of tearing and provide seal strips along the lines of tearing to maintain the hermetic nature of the sealed container.

Various means for gripping are shown, for example, by Scheibner, U.S. Pat. No. 4,363,345, who discloses a grip strip comprised of one or two ribs extruded onto the inner surfaces of bag lips. In European Pat. No. 0089680, Scheibner further discloses patterns embossed or engraved on the bag lip surfaces to provide non-slip surfaces, and the use of anti-slip materials, such as particulates, added to the plastic in the area of the bag lips to enhance gripping. See also, McCree, U.S. Pat. No. 5,009,828; issued Apr. 23, 1991, based on Ser. No. 419,975, filed Oct. 11, 1989.

Some easy-open features have been designed to also serve as a means for gripping. For example, Uramoto, in U.S. Pat. Nos. 3,827,472 (the '472 patent) and 3,780,781 (the '781 patent), discloses sealed, easy-open flexible containers which include means for tearing, parts of which remain in the bag mouth after opening to serve as means for gripping the bag lips. More specifically, in the '472 patent, sealed flexible containers, made from a film laminate having an inner and outer layer, include ribs on the inner layer either side of a tear line made in the inner layer. When the flexible containers are opened along the tear line, a single rib remains on the inside layer of each bag lip to assist in gripping the bag lips.

In the '781 patent to Uramoto and the embodiment of FIG. 13 thereof, a thermoplastic reinforcing strip is laminated to the inside surface of a container. The reinforcing strip extends across the top edge of the container and serves as a base for both zipper elements. The reinforcing strip includes opposing perforated or weakened tear lines, with ribs laminated, extruded onto, or adhered on either side of each tear line. As in the '472 patent, once the container is opened, a single rib remains on the inside layer of each bag lip to serve as a grip strip.

Among the problems encountered in producing flexible containers with easy-open features, grip strips, and reclosable zipper elements, is the concentration of the various dies needed to produce desired elements and features on the film. The area in which the various features are to be applied to the film is narrow, and space limitations make difficult the installation, adjustment and maintenance of the dies, as well as other adjacent equipment. For example, in accordance with prior art methods, eight dies are needed to produce thermoplastic film with interlocking zipper elements; bases such as shown by Kamp, U.S. Pat. No. 4,428,788; opposing areas of grip strips or ribs; and first and second seal strips for first and second perforated lines of tearing. That is, two dies are required for the zipper elements, two for the bases on which the zipper elements mount to the film, two for the opposing areas of grip strips, and two for the first and second sealing strips which seal the first and second perforated lines of tearing.

Accordingly, improvements are desired to overcome continuing problems presented by the methods and apparatuses used to prepare thermoplastic film for flexible containers, particularly where such film includes various desirable features, such as zipper elements, means for tearing, and means for gripping. As well, further improvements are continually sought in the design of easy-open flexible containers.

SUMMARY OF THE INVENTION

The present invention addresses those needs by providing an improved easy-open, reclosable, flexible container and an apparatus and method for preparing thermoplastic film for the production of such flexible containers which eliminates the clutter of dies during production.

In accordance with the method of the present invention for producing flexible containers, a continuous base layer with integrally extruded means for gripping, such as ribs, is adhered to an existing film. Preferably, the film has been perforated with first and second perforated lines of tearing, and the continuous base layer is positioned to seal those lines of tearing. The film and continuous base layer are then pressed together by at least one lay-on roller to improve adhesion between the film and continuous base layer. Zipper elements are contemporaneously extruded and fused to the continuous base layer along opposite edges thereof while all components are still hot. The zipper elements and continuous base layer are then cooled by water jets.

The film, with continuous base layer and zipper elements thereon, next advances to a means for folding, such as a folding table or other folding apparatus found in horizontal or vertical packaging machines. The film is folded to bring the zipper elements into opposing relationship, with the continuous base layer positioned along the folded edge and along adjacent portions of the opposing bag walls. Once folded, the film is then sealed and severed into individual flexible containers.

Post-application of the continuous base layer of the present invention to an existing film permits advantageous use of the position and design of the continuous base layer, ultimately simplifying the container and reducing die clutter. Produced with a single die, the continuous base layer is designed to provide integrally extruded ribs for gripping opposing bag walls, while also serving as the adhesive base, or a tie layer, for both zipper elements. Post-applied to the existing film, the continuous base layer may further be positioned to serve as the seal strip for the preferably two perforated lines of tearing provided in the existing film. Only the zipper elements require separate dies, and are contemporaneously extruded with the continuous base and fused thereon while both the zipper elements and continuous base layer are hot. Accordingly, only three dies are required to produce several desirable features on the film, to wit, a hermetically sealed means for tearing, a means for gripping, and reclosable zipper elements.

The apparatus of the present invention, thus, includes a base die for integrally extruding ribs on the continuous base layer. The base die of the present invention is constructed to permit variation in the position of the ribs across the continuous base layer, eliminating the need to make a completely new base die for each application. As well, the base die, in the preferred embodiment, is constructed to permit variation in the width of the continuous base layer independent of the rib position.

The container of the present invention which results from the method hereof preferably includes first and second perforated lines of tearing on either side of the folded edge which are hermetically sealed by attachment of the continuous base layer to the film. Tearing along the first and second lines of tearing progresses through both the film and the continuous base layer attached thereto, to open the top of the flexible container. Means for gripping, preferably ribs, are integrally extruded with the continuous base layer, and are then used to separate the interlocked zipper elements and access the bag contents.

It is thus, an object of the present invention to provide a method for post-applying or adhering a continuous base layer with integrally extruded means for gripping and zipper elements to an existing film. It is a further object of the present invention that such continuous base layer be positioned to provide a seal for perforated lines of tearing in the existing film to which it is adhered. Yet another object of the present invention is to provide a method and apparatus for producing thermoplastic film and flexible containers with a minimum of die clutter.

Further, it is an object of the present invention to provide an improved easy-open flexible container having a continuous base layer which includes an integrally extruded means for gripping. It is a further object of the present invention for such continuous base layer serve as a base for attaching interlocking zipper elements to opposing bag walls. It is yet another object of the present invention for the continuous base layer to provide a hermetically sealed, easy-open flexible container.

DETAILED DESCRIPTION OF THE PREFERRED EMBODIMENT

Figure 1:
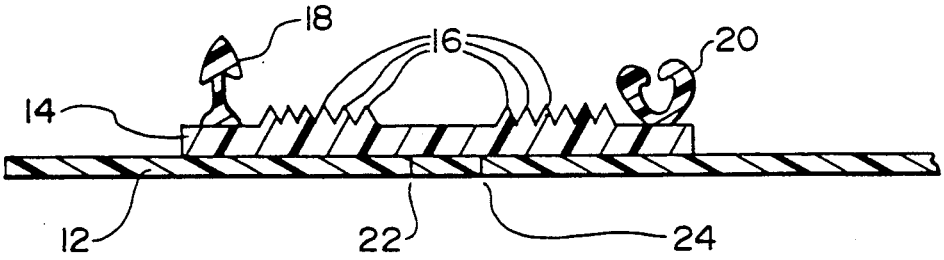
FIG. 1 is a cross-sectional view of the continuous base layer of the present invention.
Figure 2:
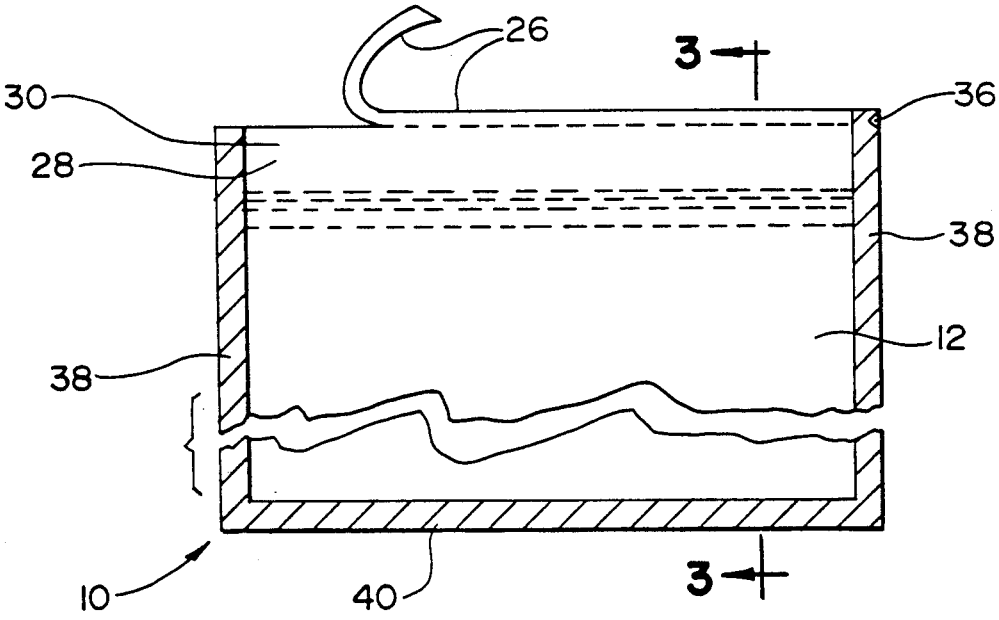
FIG. 2 is a front elevational view of a flexible container of the present invention.
Figure 3:
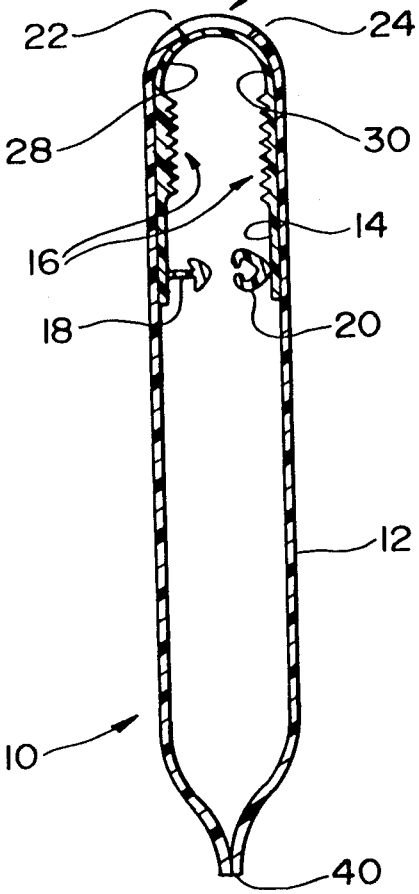
FIG. 3 is a cross-sectional view of the flexible container of FIG. 2 taken along line 3—3.
Figure 6:
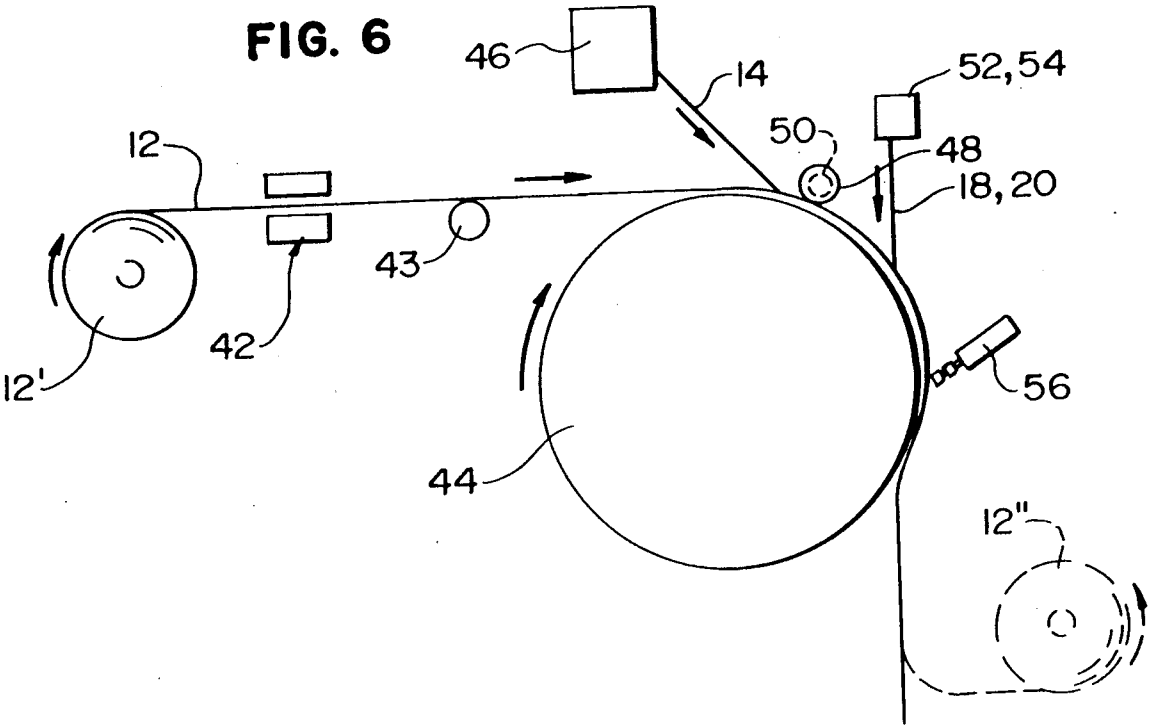
FIG. 6 is a schematic representation of the method of making the continuous base layer and application of the continuous base layer to a film in accordance with the present invention.

In accordance with the present invention a method for making the container 10 of FIGS. 1–3, having a continuous base layer 14 thereon, is schematically shown in FIG. 6. Referring to FIG. 6, film roll 12' is provided and film 12 advanced to perforating station 42 where first and second perforated lines of tearing 22, 24 are made in film 12. Alternatively, film roll 12' could be provided pre-perforated. Thereafter, film 12 advances to cast roll 44, preferably a rotatable drum, on which film 12 may be securely positioned. Continuing thereafter, film 12 encounters continuous base layer 14 as it is extruded from base die 46. A tensioning roller or so-called "baggy edge elimination roller" 43 may also be provided as shown in FIG. 6 to accommodate dimensional variations in film 12 and reduce wrinkling of film 12 as it is laid on cast roll 44. Further, cast roll 44, adapted for cooling by water or a heat transfer fluid in a manner known in the art, may be cooled when precooling of film 12 or heat removal from continuous base layer 14 is desired. Cast roll 44 may also be heated with such heat transfer fluid when pre-heating of film 12 or heat, in addition to that provided by continuous base layer 14, is desired. The method of the present invention may, thus, further include a the step of thermally conditioning film 12 during at least part of the time film 12 advances. Such cooling or heating, however, is not preferred or considered necessary to practice the preferred embodiment of the present invention.

As shown in FIG. 6, continuous base layer 14, integrally extruded with means for gripping, such as ribs 16, is brought into contact with film 12 on cast roll 44. Film 12 and continuous base layer 14 are then pressed together by one or more, preferably one, lay-on roller 48, which helps to adhere continuous base layer 14 to film 12. Lay-on roller 48 includes recesses 50 in which ribs 16 are positioned to prevent crushing ribs 16 while pressure is applied to continuous base layer 14, preferably both outside and between the areas in which ribs 16 are extruded. The surfaces of lay-on roller 48 are preferably teflon-coated, particularly those surfaces in contact with continuous base layer 14.

Alternatively, adherence of continuous base layer 14 to film 12 may be enhanced by directly positioning high pressure air knives (not shown) across the width of continuous base layer 14 to provide air pinning of continuous base layer 14 to film 12. Best results have been obtained, however, with lay-on roller 48, which is preferred.

First and second zipper elements 18, 20 are next extruded from dies 52 and 54, respectively. Zipper elements 18, 20 are fused to continuous base layer 14 while all are hot. Thereafter, the zipper elements 18, 20, continuous base layer 14, and film 12 are cooled by one or more cooling water jets 56, and advance either for winding into finished film roll 12" or for further processing, as described below.

Figure 7:
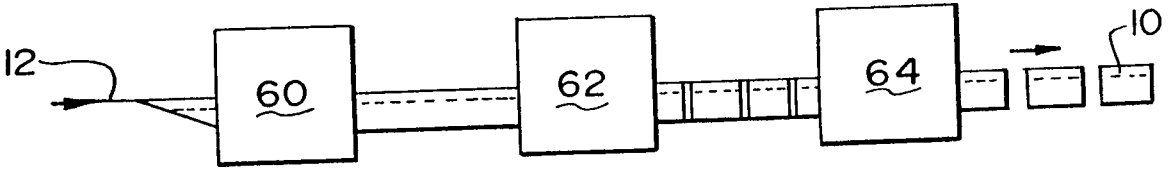
FIG. 7 is a schematic representation of the method of making a flexible container of the present invention.

In a further aspect of the method of the present invention, shown in FIG. 7, film 12 with continuous base layer 14 and zipper elements 18, 20 attached thereto, may be further processed, advancing for folding by means for folding 60, sealing at sealing station 62, and severing with at severing station 64, to form the containers 10 of the present invention. The steps of folding, sealing and severing in accordance with the present invention may be performed on horizontal or vertical packaging or container manufacturing equipment, or components thereof. Equipment of this type is well known in the art. See, for example, U.S. Pat. Nos. 4,663,915; 4,617,683; and 4,582,549, the disclosures of which are hereby incorporated by reference.

In any event, the film 12 is folded to bring the zipper elements 18, 20 into opposing relationship, and position the continuous base layer 14 along the folded edge 26 and adjacent portions of the first and second opposing bag walls 28, 30. Once folded, film 12 is then sealed along bag side seals 38 and bottom seal 40, or may be partially sealed along bag side seals 38, with the bottom seal 40 left unformed to permit later filling with product. Similarly, film 12, folded and at least partially sealed, may be left in a chain or severed into individual flexible containers. Preferably a notch 36 is provided in one or both of bag side seals 38 to help initiate tearing across top edge 26, along first and second perforated lines of tearing 22, 24.

Film 12 is preferably made of polyethylene and substantially 2 to 3 mils thick. The thickness of film 12 is not critical and may be thicker so long as tearing along first and second lines of tearing 22, 24 remains possible, and may be thinner so long as film 12 does not melt entirely upon contact with continuous base layer 14 as it is extruded hot from base die 46. By way of illustration, not limitation, a typical width of film 12 for moderately sized containers 10 may be approximately 20 inches.

Continuous base layer 14 is preferably made of low density polyethylene (LDPE), such as Dow 751 resin from The Dow Chemical Co., Midland, MI. Continuous base layer 14 is preferably extruded at 475 degrees Fahrenheit (F), which provides an easy, consistent extrusion. Similarly, zipper elements 18, 20 are preferably made of LDPE, and are preferably extruded at 460 F. Other thermoplastic materials may be suitable but LDPE is preferred.

Continuous base layer 14 is preferably approximately 2.5 inches wide and approximately 1 to 2 mils thick. By way of example, but not limitation, such a continuous base layer 14 of LDPE may be achieved on film 12 with a 1 inch drawdown from base die 46 to cast roll 44, where base die 46 has a base opening 70 of approximately 4.25 inches wide by approximately 0.030 inches high, where the extrusion pressure is approximately 1500 pounds per square inch (psi), and where film 12 advances on cast roll 44 at approximately 30 feet per minute.

Continuous base layer 14 may be from substantially 0.5 mils to substantially 3 mils thick, but is preferably 1 to 2 mils thick. When continuous base layer 14 is too thin, extrusion thereof becomes more difficult as continuous base layer 14 tends to break during drawdown before reaching film 12. As well, because it acts as a heat source to soften the surface of film 12 for adhesion, continuous base layer 14, when too thin, provides less heat, and adherence to film 12 declines. Production of a very thin continuous base layer 14 presents one of the circumstances where heating of cast roll 44 to pre-heat film 12 or to add heat to film 12 to improve adherence may be desirable. When too thick, continuous base layer 14 resists tearing. However, continuous base layers thicker than 3 mils may be possible if they are extruded in a manner or of a material which tends to tear in the desired direction of opening. Further, production of thick continuous base layers 14 may provide too much heat to film 12, causing melting of film 12, and may present one of the circumstances where cooling of cast roll 44 to remove excess heat may be desirable.

With reference to FIGS. 2 and 3, reclosable flexible container 10 of the present invention is made of thermoplastic film 12 having continuous base layer 14 attached to the inner surface thereof. Shown best in FIG. 1, continuous base layer 14 includes integrally extruded means for gripping, preferably ribs 16, as shown. First and second zipper elements 18, 20 attach to continuous base layer 14 generally along opposite edges thereof. Continuous base layer 14 serves to tie zipper elements 18, 20 to the film and is also positioned to hermetically seal first and second perforated lines of tearing 22, 24 provided in film 12. First and second perforated lines of tearing 22, 24 permit easy-opening of the flexible container 10. Tearing therealong removes the top edge 26 of container 10, as well as contiguous portions of continuous base layer 14 adhered thereto.

Figure 8:
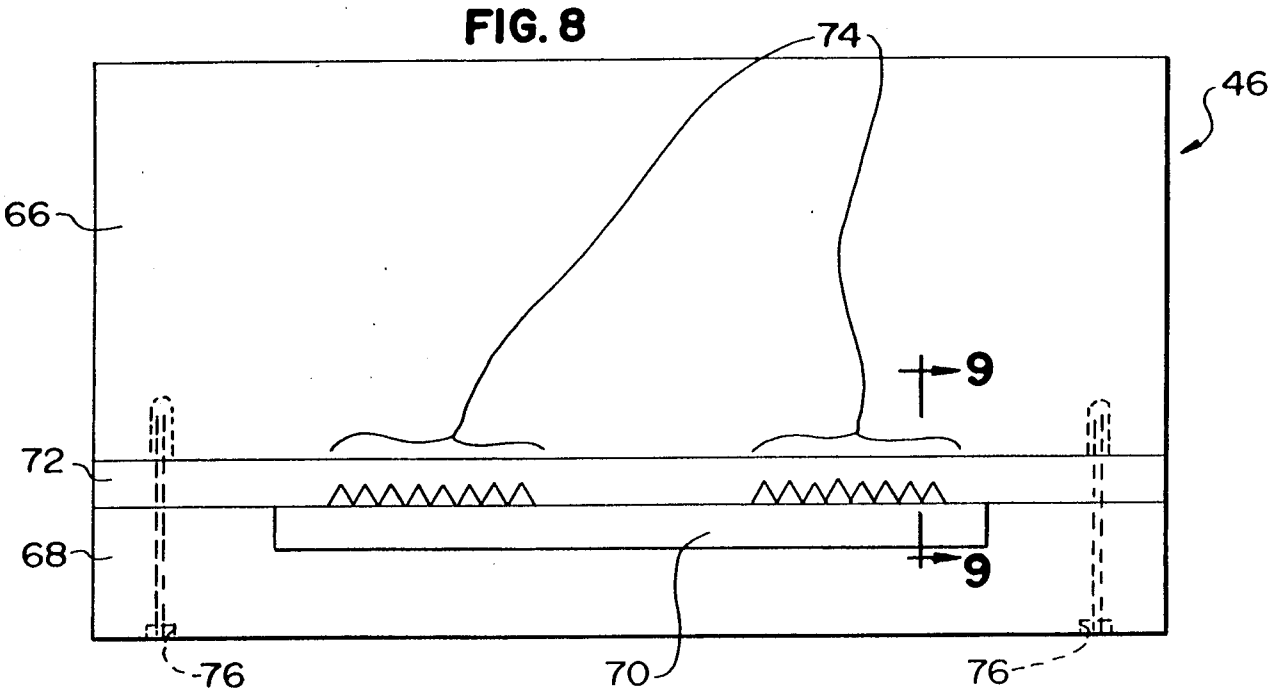
FIG. 8 is a front elevational view of the base die of the present invention.

As shown in FIGS. 1–5, a plurality of ribs 16 is preferred, preferably eight, as shown in FIG. 8, covering an area generally one-half inch wide on each opposing bag wall. A plurality of ribs 16 enhances gripping of first and second bag lips 28, 30 after the top edge 26 of container 10 is removed. Alternatively, means for gripping may be grooves, however, ribs 16 are preferred.

Figure 5:
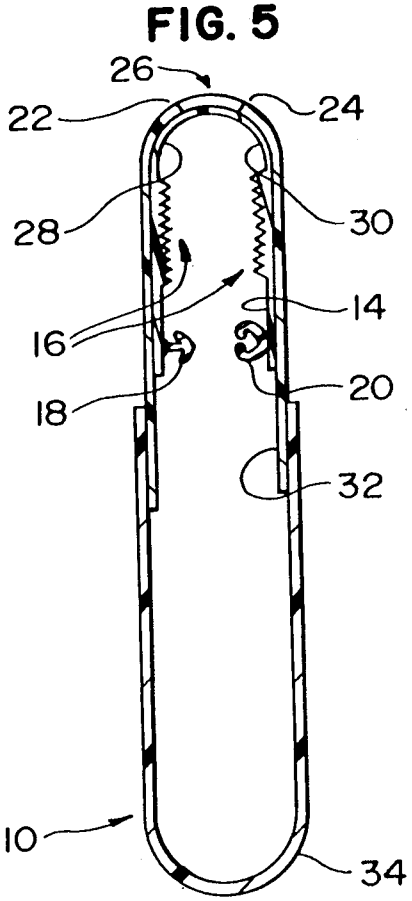
FIG. 5 is a cross-sectional view of a second alternative embodiment of the present invention.
Figure 4:
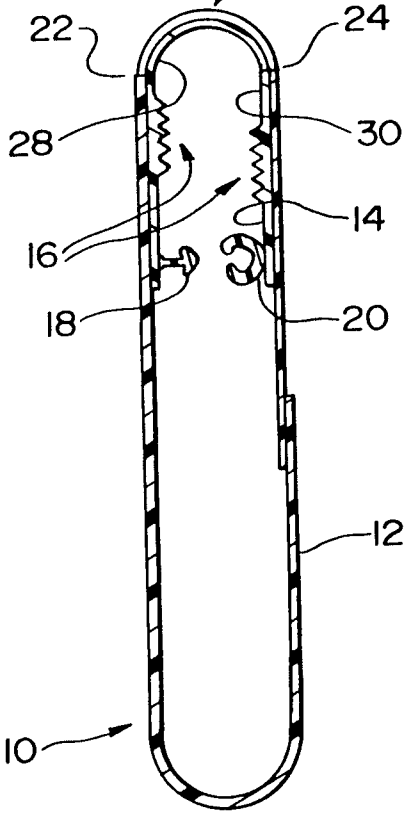
FIG. 4 is a cross-sectional view of a first alternative embodiment of the present invention.

Alternative embodiments of container 10 of the present invention are shown in FIGS. 4 and 5. In FIG. 4 one of the perforated lines of tearing, for example first perforated line of tearing 22, extends through the continuous base layer 14 as well asthrough the film 12, to enhance removal of top edge 26. In accordance with the method of the present invention, the step of perforating first perforated line of tearing 22 may occur after continuous base layer 14 and zipper elements 18, 20 are attached to film 12. This embodiment is not preferred, however, because the perforation through continuous base layer 14 eliminates the hermetic seal of container 10.

The alternative embodiment of FIG. 4 also representatively shows that seam 40 of container 10 may be formed other than at the bottom of container 10, such as may be the case on a horizontal packaging machine. Similarly, FIG. 4 shows that continuous base layer 14 need not be adhered generally centrally across film 12.

In the alternative embodiment of FIG. 5, continuous base layer 14 is shown attached to membrane 32 which, in turn, is attached to bag body 34 of film 12 to form container 10. This alternative embodiment permits the present invention to be incorporated in a membrane 32, and membrane 32 later combined, when cooled, the bag body 34 of container 10. In this embodiment, membrane 32 is perforated and continuous base layer 14 is applied thereto in accordance with the method of the present invention set forth above with regard to film 12.

Figure 9:
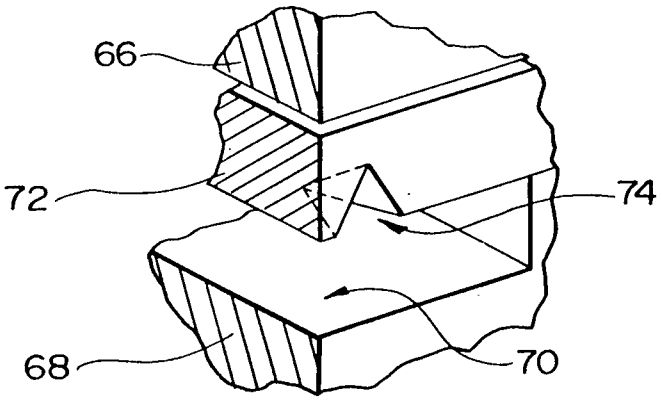
FIG. 9 is a schematic perspective view of a portion of the grip strip plate of base die of FIG. 8, taken along line 9—9.

Base die 46 of the present invention is shown in more detail in FIGS. 8 and 9. Referring to the preferred embodiment of FIG. 8, base die 46 is comprised of three components: die body 66, base plate 68, which defines the size of base opening 70 for continuous base layer 14, and grip strip plate 72, which includes a plurality of rib forming channels 74. Die body 66, base plate 68 and grip strip plate 72 are connected by bolts 76 as shown. Die body 66 is typical of those known in the prior art, and is adapted for operation at typical pressures, for example, approximately 1500 psi. In an alternative embodiment, a portion of base opening 70 may be included in grip strip plate 72 with rib forming channels 74. However, the flexibility of design, detailed below, is compromised, and the alternative embodiment is not preferred.

In accordance with the preferred embodiment of the present invention, by virtue of grip strip plate 72 being separable from die body 66 and base plate 68, grip strip plate 72 may be removed and replaced with a modified grip strip plate (not shown) to increase the size, number, shape or location of ribs produced on the surface of the continuous base layer 14. Similarly, the width or height of the base opening 70 in base plate 68, preferably a generally rectangular shape with sides approximately 4.0 to 4.5 inches wide and approximately 0.030 inches high, may be changed without need to reform rib forming channels 74. Maximum flexibility is thereby possible in adapting a single base die 46 to provide a continuous base layer 14 with integral ribs 16 for various applications.

As shown best in FIG. 9, rib forming channels 74 taper down to a point from their triangular shape on the face of grip strip plate 72. Where extrusion of LDPE is carried out at approximately 1500 psi, preferred dimensions of rib forming channels would be substantially 0.10 inches high at the peak, substantially 0.04 inches wide across the face of grip strip plate 72, and substantially 0.30 inches deep into base die 46 from the face of grip strip plate 72. If a higher extrusion pressure is used, the depth of the taper may be less, and where lower, the taper must be deeper and more gradual. Thus, the dimensions of rib forming channels 74 may be approximately 0.033 to 0.333 inches high at the peak, approximately 0.013 to 0.133 inches wide across the face of grip strip plate 72, and approximately 0.1 to 1.0 inches deep into base die 46 from the face of grip strip plate 72.

Materials used to make base die 46, as well as other apparatus components, and means for connecting the components of the apparatuses disclosed and described are conventional, unless otherwise indicated.

In the operation of base die 46 and the method of the present invention, some iterative refinement of the parameters set forth herein may be necessary to adapt particular apparatus components used to achieve the results defined by the present invention. As well, variation in the polymer output of base die 46, variation in the operating pressures of base die 46, the dimensions of rib forming channels 74, the size of base opening 70, the drawdown, and the speed of film 70 is possible to vary the dimensions of the ribs and continuous base layer 14 to adapt the results to suit various applications.

Thus, while certain representative embodiments and details have been shown for purposes of illustrating the present invention, it will be apparent to those skilled in the art that various changes in the articles, apparatus and methods disclosed herein may be made without departing from the scope of the invention, which is defined in the appended claims.

What is claimed is:

1. An easy-open, reclosable, flexible container comprising:

a sealed bag body of folded thermoplastic film having opposing first and second bag walls;

a continuous base layer attached to the inner surface of said sealed bag body, said continuous base layer coextensive with a folded edge of said sealed bag body and with portions of said opposing first and second bag walls;

first and second interlocking zipper elements attached in spaced relationship to said continuous base layer on opposing portions thereof;

means for tearing said container positioned in said sealed bag body along a line where said sealed bag body is coextensive with said continuous base layer; and said continuous base layer further comprising one or more means for gripping integrally extruded on the inner surface of said continuous base layer.

2. A container as recited in claim 1 wherein said continuous base layer has a thickness of from substantially 0.5 mils to substantially 3 mils.

3. A container as recited in claim 1 wherein said continuous base layer has a thickness of from substantially 1 mil to substantially 2 mils.

4. A container as recited in claim 1 wherein said continuous base layer has a width of substantially 2.5 inches.

5. A container as recited in claim 1 wherein said continuous base layer is comprised of low density polyethylene.

6. A container as recited in claim 1 wherein said means for tearing comprises first and second perforated lines of tearing.

7. A container as recited in claim 6 wherein at least one of said first and second perforated lines of tearing are positioned in said folded edge of said bag body which is coextensive with said continuous base layer.

8. A container as recited in claim 6 wherein at least one of said first and second perforated lines of tearing extends through said continuous base layer.

9. A container as recited in claim 1 wherein said means for gripping comprises at least one group of three or more ribs.

10. A container as recited in claim 9 wherein said at least one group of three or more ribs covers an area substantially 0.5 inches wide.

11. A container as recited in claim 1 wherein said means for gripping comprises two groups of two or more grooves in spaced relationship in said continuous base layer.

12. A container as recited in claim 1 wherein:

said first and second interlocking zipper elements are disposed generally near opposite edges of said continuous base layer;

said means for gripping comprise first and second groups of ribs in spaced relationship on opposing portions of said continuous base layer between said first and second interlocking zipper elements; and said means for tearing comprises first and second perforated lines of tearing positioned in said sealed bag body between said first and second groups of ribs.

13. A thermoplastic film structure comprising:

a folded thermoplastic membrane having a folded edge and opposing first and second walls;

a continuous base layer attached to the opposing surfaces of said first and second walls, said continuous base layer coextensive with said folded edge and with at least part of said opposing first and second walls;

first and second interlocking zipper elements attached in spaced relationship to said continuous base layer on opposing portions thereof;

means for tearing said membrane positioned in said membrane along a line where said sealed bag body is coextensive with said continuous base layer, said means for tearing comprising first and second perforated lines of tearing disposed in said membrane; and said continuous base layer further comprising one or more means for gripping integrally extruded on the inner surface of said continuous base layer.

* * * * *

UNITED STATES PATENT AND TRADEMARK OFFICE

CERTIFICATE OF CORRECTION

PATENT NO. : 5,092,684

DATED : March 3, 1992

INVENTOR(S) : Ronald J. Weeks

It is certified that error appears in the above-identified patent and that said Letters Patent is hereby corrected as shown below:

Column 4, line 27, "a" should be deleted;

Column 4, line 65, "with" should be deleted;

Column 6, line 31, "asthrough" should be --as through--; and

Column 6, line 51, --with-- should be inserted before "the".

Signed and Sealed this

Fifteenth Day of June, 1993

*Attest:*

*Attesting Officer*

Michael K. Kirk

MICHAEL K. KIRK

*Acting Commissioner of Patents and Trademarks*